US005863086A

United States Patent [19]

Christenson

[11] Patent Number: 5,863,086

[45] **Date of Patent: *Jan. 26, 1999**

[54] CONTAINER HOLDING AND LIFTING DEVICE

[75] Inventor: Ronald E. Christenson, Parsons, Tenn.

[73] Assignee: McNeilus Truck and Manufacturing, Inc., Dodge Center, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 815,675

[22] Filed: Mar. 12, 1997

Related U.S. Application Data

[63] Continuation of Ser. No. 342,752, Nov. 21, 1994, abandoned.

[51] Int. Cl.[6] ..... B65F 3/04; B66C 1/44

[52] U.S. Cl. ..... 294/106; 294/65; 294/88; 294/902

[58] Field of Search ..... 294/2, 3, 64.1, 294/65, 86.4, 88, 106, 111, 902; 414/406, 408, 409, 422, 555, 620, 621, 739; 901/37, 39

[56] References Cited

U.S. PATENT DOCUMENTS

| | | | |
|---|---|---|---|
| Re. 34,292 | 6/1993 | Bingman et al. . | |
| 2,739,008 | 3/1956 | Renner | 294/902 X |
| 3,227,299 | 1/1966 | Draxler | 294/88 X |
| 3,841,508 | 10/1974 | Ebeling et al. | 214/302 |
| 3,982,782 | 9/1976 | Bos | 294/64.1 |
| 4,227,849 | 10/1980 | Worthington . | |
| 4,367,891 | 1/1983 | Wauer et al. | 294/902 X |
| 4,401,407 | 8/1983 | Breckenridge . | |
| 4,452,479 | 6/1984 | Terai et al. | 294/106 X |
| 4,461,607 | 7/1984 | Smith | 414/406 |
| 4,461,608 | 7/1984 | Boda . | |
| 4,543,028 | 9/1985 | Bell et al. | 414/408 |
| 4,566,840 | 1/1986 | Smith . | |
| 4,597,710 | 7/1986 | Kovats | 414/409 |
| 4,669,940 | 6/1987 | Englehardt et al. . | |
| 4,708,570 | 11/1987 | Smith et al. . | |
| 4,844,682 | 7/1989 | Edelhoff . | |
| 4,868,796 | 9/1989 | Ahrens et al. . | |
| 4,872,801 | 10/1989 | Yeazel et al. . | |
| 4,943,201 | 7/1990 | Billon . | |
| 4,986,074 | 1/1991 | Hahmann et al. . | |
| 5,007,786 | 4/1991 | Bingman . | |
| 5,026,104 | 6/1991 | Pickrell . | |
| 5,033,930 | 7/1991 | Kraus . | |
| 5,035,563 | 7/1991 | Mezey | 414/409 |
| 5,049,026 | 9/1991 | Bingman et al. . | |
| 5,074,740 | 12/1991 | Weigel | 294/106 X |
| 5,092,731 | 3/1992 | Jones et al. . | |
| 5,114,297 | 5/1992 | Kirchhoff . | |
| 5,125,706 | 6/1992 | Kuwaki et al. | 294/65 |
| 5,163,805 | 11/1992 | Mezey | 414/786 |
| 5,169,195 | 12/1992 | Kirchhoff . | |
| 5,205,698 | 4/1993 | Mezey | 414/406 |
| 5,209,537 | 5/1993 | Smith et al. . | |
| 5,215,423 | 6/1993 | Schulte-Hinsken et al. . | |
| 5,230,393 | 7/1993 | Mezey . | |
| 5,303,841 | 4/1994 | Mezey | 220/555 |
| 5,360,310 | 11/1994 | Jones et al. | 414/409 |
| 5,391,039 | 2/1995 | Holtom | 414/408 |

FOREIGN PATENT DOCUMENTS

| | | |
|---|---|---|
| 60231 | 2/1991 | Australia . |
| WO9105721 | 5/1991 | WIPO . |
| WO92/01612 | 2/1992 | WIPO . |
| WO9421540 | 9/1994 | WIPO . |

*Primary Examiner*—Johnny D. Cherry
*Attorney, Agent, or Firm*—Haugen and Nikolai, P.A.

[57] ABSTRACT

Grasping devices including arms pivotally connected to a support member and moved by actuators pivotally connected between the arms and the support member are described. The arms may be either single or multiple member limbs shaped to engage a variety of geometrically shaped objects. Multiple member embodiments include an outer member pivotally connected to an inner member which is pivotally connected to the support member. Each arm may carry a suction cup. The support members of each embodiment may be connected to any lifting device, such as a compound arm attached to a refuse truck.

7 Claims, 4 Drawing Sheets

CONTAINER HOLDING AND LIFTING DEVICE

This is a continuation of application Ser. No. 08/342,752, filed on Nov. 21, 1994 now abandoned.

BACKGROUND OF THE INVENTION

I. Field of the Invention

This invention relates generally to material handling equipment and, more particularly, to a grasping device attached to a refuse collection vehicle for handling containers during collection efforts.

II. Discussion of the Prior Art

As the world of materials handling becomes more mechanized the desire to move objects with minimal human intervention increases. Raw materials must be moved from one facility to another for mass production; products must be shipped to users; and refuse must be removed. Mechanized devices have been created to move material and reduce the human intervention needed.

Mechanized material handling devices of the class of interest to the present invention usually have a grasping device attached to a large arm or other means for lifting, moving and tipping a container or object of interest. The grasping device often has a pair of spaced and opposed mechanical arms which function to grasp and release a container by closing down and opening up as operated by one or more actuating devices, such as hydraulic cylinders. In situations where only one actuating device is used, a linkage mechanism is required to achieve dual arm movement.

Grasping devices including a single actuator and a pair of arcuate arms are described in U.S. Pat. No. 4,461,608, to Boda; U.S. Pat. No. 4,708,570, to Smith et al; and U.S. Pat. No. 5,026,104, to Pickrell. Each of the devices described in these patents includes a relatively complex linkage mechanism. Boda describes an apparatus including a pair of arcuate arms connected to a common support member at spaced pivot joints. A shaft is connected to each arm and to a lever arm wherein movement of the lever arm by an actuator causes the shaft to rotate to move the gripping arms. Smith et al describe a grasping device including a single actuator pivotally connected to an arcuate arm and a connecting rod attached to this arm to operate a second arcuate arm to grasp an object of interest. Pickrell describes a gripping device having a single actuator attached to a lever which, in turn, is attached to rotate an arcuate arm having gears meshed with gears operating a second arcuate arm. The arms carry a belt or flexible mechanism to enclose and grab circular objects of various sizes. In each of these systems a relatively complex linkage mechanism is required to move the arms.

Grasping devices including multiple actuators and two single member arcuate arms have been described in U.S. Reissue Pat. No. 34,292, and U.S. Pat. Nos. 4,227,849 and 4,872,801. In each these patents, the arms are pivotally attached to a common support member and operated by hydraulic cylinders pivotally attached to the same support member.

A grasping device including multiple actuators and arms having multiple members is described in U.S. Pat. No. 4,669,940, issued to Englehardt et al. In this patent, a pair of straight secondary arms are pivoted to a common support member inside a pair of angled primary arms. The secondary arms roll along the inside of the primary arms to form a hexagon as the primary arms are pushed together by hydraulic cylinders.

U.S. Pat. No. 5,092,731, issued to Jones et al, describes a grasping device including two compound (segmented) arcuate arms linked to an I-beam member operated by actuators. The inner portion or segment member of each arm is slidably attached to the I-beam member which, in turn, is pivotally attached to the common support member. The I-beams rotate to move the inner members between an open and a closed position as the actuating hydraulic cylinders retract and expand, respectively. The outer portions or segment members of each arm are pivotally attached to the inner member and rollers at the end of each I-beam cause the outer members to rotate about the pivot joint to grasp an object.

The devices discussed above are designed to grasp circular objects. A device for lifting and holding containers having a plurality of basic shapes is described in U.S. Pat. No. 4,401,407, to Breckenridge. Breckenridge describes a device having a pair of arms including an inner member pivoted at one end to a frame and an outer member pivoted between its ends to the second end of the inner member. A complex linkage mechanism is attached between the frame and the two members for coordinating movement of the inner and outer members. While the mechanism is functional, a mechanically simpler device for grasping containers having a plurality of shapes is desired.

PCT International Application Publication No. WO 92/01612 describes a device for grasping containers of several shapes. The described device includes oppositely disposed compound articulated arms pivotally attached to a central support member. Each arm includes an inner and an outer member curved to fit around a container and having grip padding for holding the container. In operation, the arms are moved by four actuators. However, the shape of the arms and the grip padding is a compromise, not shaped to fit snugly around the corners of a rectangular object. The corners of a rectangular object fall between the grip padding or are contacted at an angle which limits the ability of the device to manipulate rectangular objects.

It is accordingly a principal object of the invention to provide a mechanically simplified device for handling objects of various shapes.

Another object of the invention is to provide a grasping device for securely grasping objects of various shapes.

Yet another object of the invention is to provide a mechanically simplified grasping device including actuators for grasping objects of various shapes.

Still another object of the invention is to provide a mechanically simplified grasping device including two single element arms wherein each arm is connected to an actuator for grasping objects of various shapes.

A further object of the invention is to provide a simplified grasping device including two compound arms each having an inner member and an outer member wherein only each outer member is connected to an actuator for grasping objects of various shapes.

A still further object of the invention is to provide a simplified grasping device including four actuators for securely grasping objects of various shapes.

A yet still further object of the invention is to provide a simplified grasping device including two arms each having an inner member and an outer member and four actuators connected to the arms for securely grasping objects of various shapes.

Other objects, features and advantages of the present invention will become apparent to those skilled in the art through familiarity with the summary of the invention, detailed description, claims, and drawings herein.

SUMMARY OF THE INVENTION

The foregoing objects of the present invention are attained by providing a grasping device having a pair of spaced, opposed arms pivotally connected to a central support member. The arms are shaped to fit around containers of a plurality of different shapes, including curved, rectangular, hexagonal and others. The arms are pivoted between an open or retracted position and a closed or grasping position by operating actuators. The device does not require a complex linkage mechanism for moving or coordinating the movement of the arms to securely grasp objects of various shapes.

The grasping device of the invention is described in terms of three exemplary embodiments. The arms may be either single or plural member type arms having a curvilinear shape to fit around containers of a plurality of different shapes.

Two plural member or articulated dual arm embodiments are described in which each arm has an inner member pivotally connected at one end to a common support member and an outer member pivotally connected to a corresponding inner member. The inner and outer members have shaped inner surfaces to enable them to grasp containers having a plurality of different geometric shapes, such as circular, rectangular or hexagonal. Each outer member has a roller which contacts and urges the container of interest toward the common support member to retain the container in place. In one of the articulated embodiments, each arm has a suction cup for securely grasping the container of interest. A single member dual arm embodiment utilizes two one-piece arms pivotally connected to a common support member and having indentations or smooth shaped inner surfaces and a suction cup to enhance holding strength. In each embodiment, the common support member has a recessed curved portion and flat portions for receiving containers of a plurality of different shapes.

Each embodiment includes an actuator device, such as a fluid operated double acting cylinder, pivotally connected between each arm and the common support member. The pivot points of the arms are closer together and closer to the container of interest than those of the actuators in the common support member to provide leverage and allow the arms to grasp the container of interest on the power stroke of the double acting hydraulic cylinders.

In one two-piece articulated arm embodiment, a single actuator is attached to each arm at the outer member to rotate the inner and outer members around the container of interest. In the second articulated arm embodiment, each arm has a first actuator attached to the inner member and a second actuator attached to the outer member to rotate the members around the container of interest. The actuators connected to the common support member urge the members away from the support member. The inner member rotates at the pivot point in the support member to contact the container of interest. Thereafter, the outer member closes about the object or container of interest.

The support member of the grasping device may be mounted to any compatible lifting apparatus. For example, it may be mounted to a material handling truck, such as a forklift, or a mechanical arm attached to a refuse truck for grasping, lifting, dumping (tipping) and replacing refuse containers, as it is in the preferred embodiment. In the latter situation, the mechanical arm is manipulated to position the grasping device around a container of interest. The grasping device is then closed to grasp the container and the arm is manipulated to lift and tip the container.

DETAILED DESCRIPTION

Figure 1:
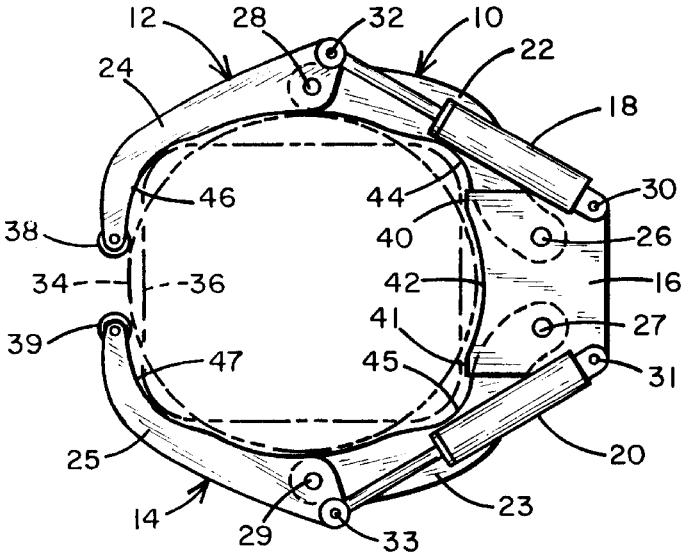
FIG. 1 is a top view of one articulated arm embodiment in the grasping position.
Figure 2:
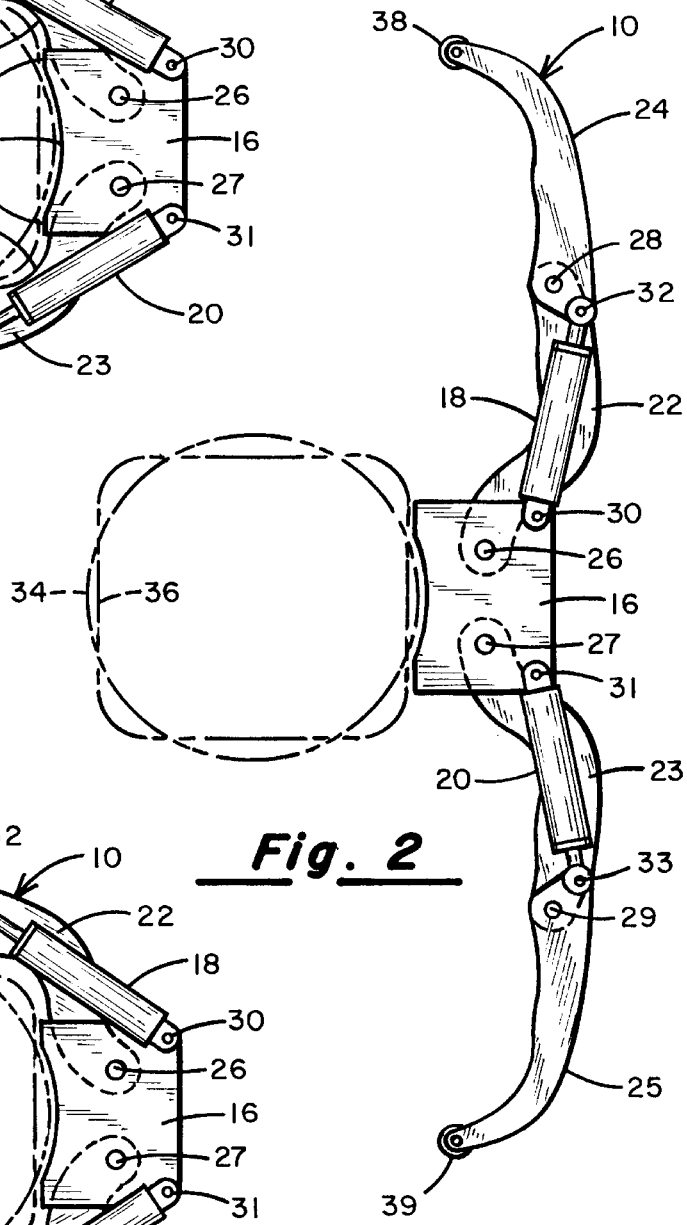
FIG. 2 is a view of the embodiment of FIG. 1 in the retracted position.
Figure 3:
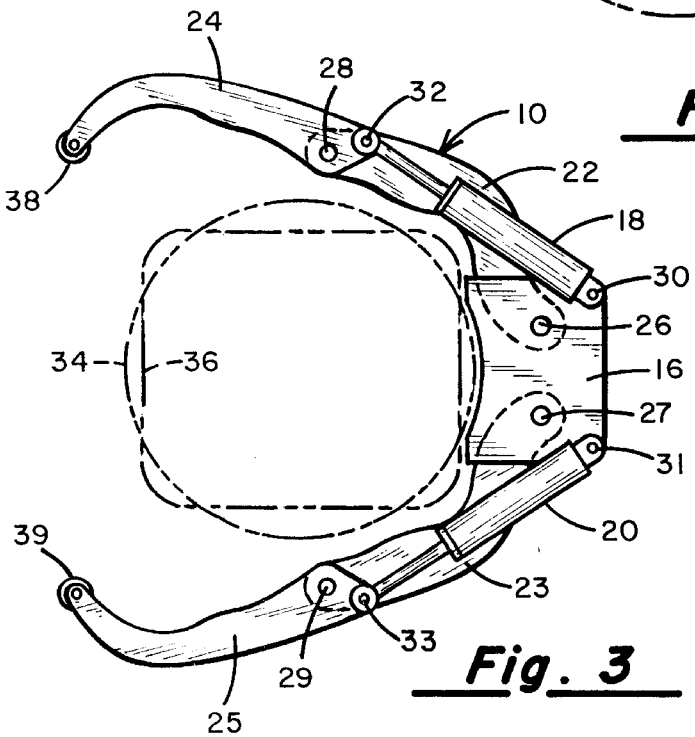
FIG. 3 is a view of the embodiment of FIG. 1 in an intermediate position.

A double member or articulated arm embodiment of the grasping device of the present invention is shown in FIGS. 1–3 and a second embodiment of the same type is shown in FIGS. 4–7. The grasping device shown in FIGS. 1–3is indicated generally by the numeral 10 and has two compound arms 12 and 14 pivotally connected at one end to a support member 16. The arms 12 and 14 are moved by actuators, such as hydraulic cylinders 18 and 20 pivotally connected between the arms 12 and 14 and the support member 16. As described below, expanding and retracting the actuators 18 and 20 moves the arms 12 and 14 between a grasping position, shown in FIG. 1, and a fully retracted or open position, shown in FIG. 2.

Arms 12 and 14 have inner members 22 and 23 pivotally connected to the support member 16 at first support pivot points 26 and 27 and pivotally connected to outer members 24 and 25 at arm member pivot points 28 and 29. Actuators 18 and 20 are pivotally connected to the support member 16 at second support pivot points 30 and 31 and to outer members 24 and 25 at offset pivot points 32 and 33.

As shown in FIGS. 1–3, expanding hydraulic cylinder actuators 18 and 20, operating via offset pivot points 32 and 33, and support pivot points 26, 27, 30 and 31, causes inner members 22 and 23 to close around a container of interest. Likewise, outer members 24 and 25 pivot about arm member pivot points 28 and 29 to contact and grasp the container of interest. Contact rollers 38 and 39 carried by the outer members 24 and 25 operate to urge containers of a plurality of different shapes toward and securely hold the containers against the support member 16. Retracting hydraulic cylinder actuators 18 and 20 reverses this sequence and opens the grasping device 10 to the position shown in FIG. 2.

Support member 16 has a rounded surface at 42 to receive a rounded or circular container 34 and a pair of flat surfaces 40 and 41 to receive a rectangular container 36. Round and rectangular shaped containers are representative of the variety of shapes the grasping device of the invention can engage. Other shapes that can be grasped include hexagonal and oblong shapes.

In the example shown, the grasping device 10 holds either a rounded container 34 or a rectangular container 36 with equal dexterity. Inner members 22 and 23 have first corresponding and opposed shaped inner surfaces 44 and 45 and outer members 24 and 25 have second corresponding and opposed shaped inner surfaces 46 and 47 to fit around the corners of a rectangular container 36. Together, inner members 22 and 23 and outer member 24 and 25 produce a smooth rounded surface for holding a rounded container 34.

Figure 4:
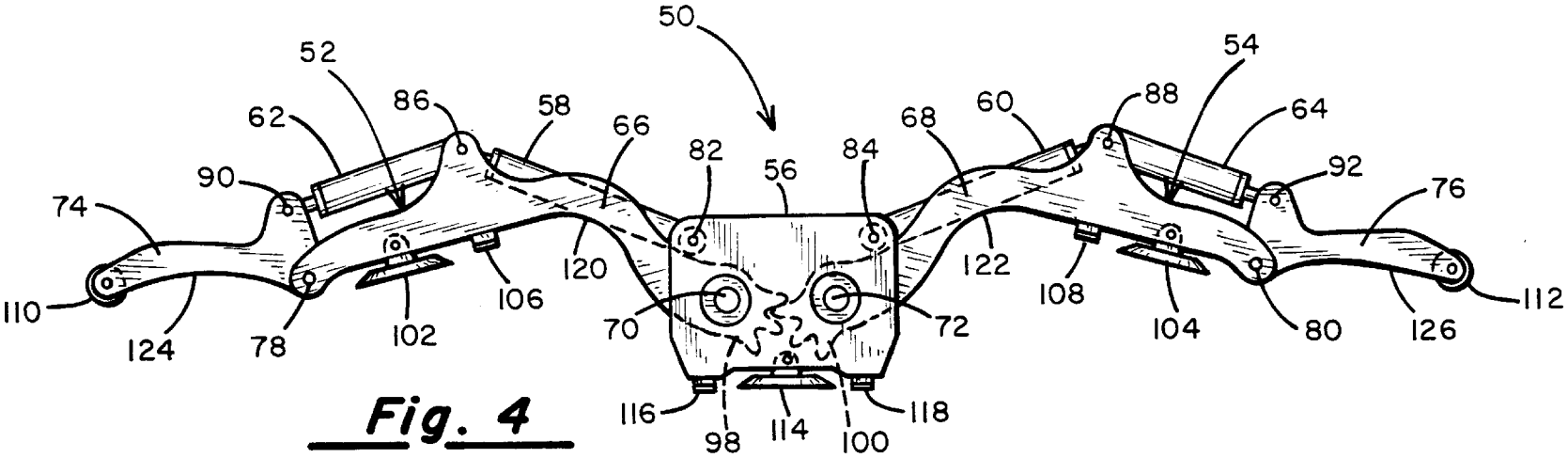
FIG. 4 is a top view of an alternative articulated arm embodiment in the retracted position.
Figure 5:
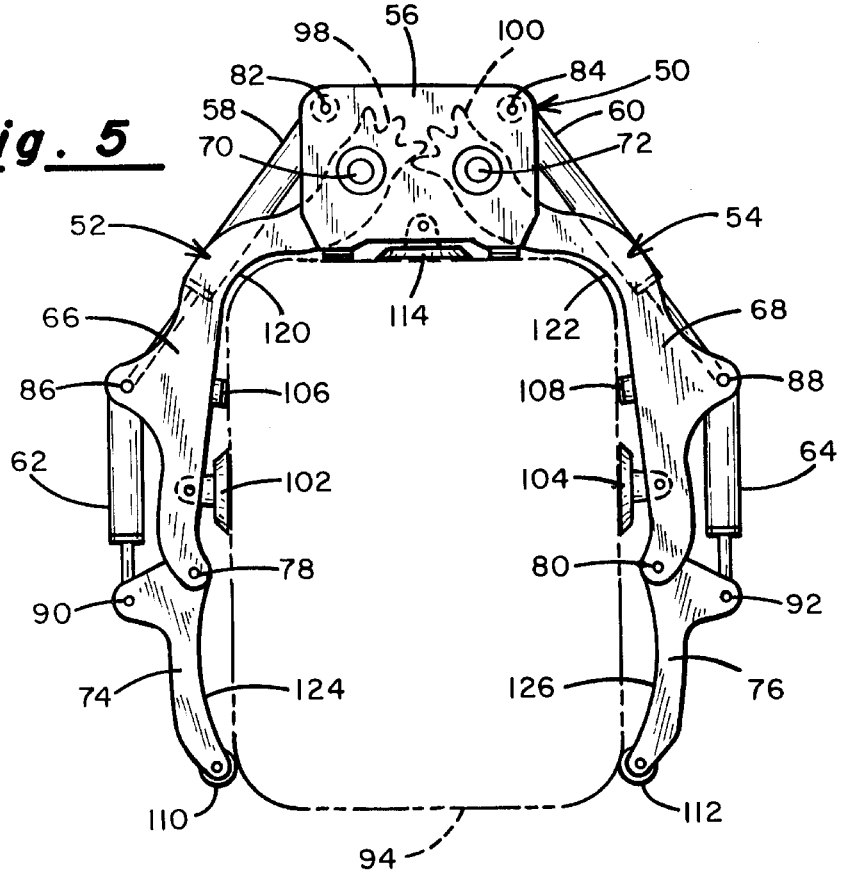
FIG. 5 is a view of the embodiment of FIG. 4 in the grasping position with reference to a rectangular object.
Figure 6:
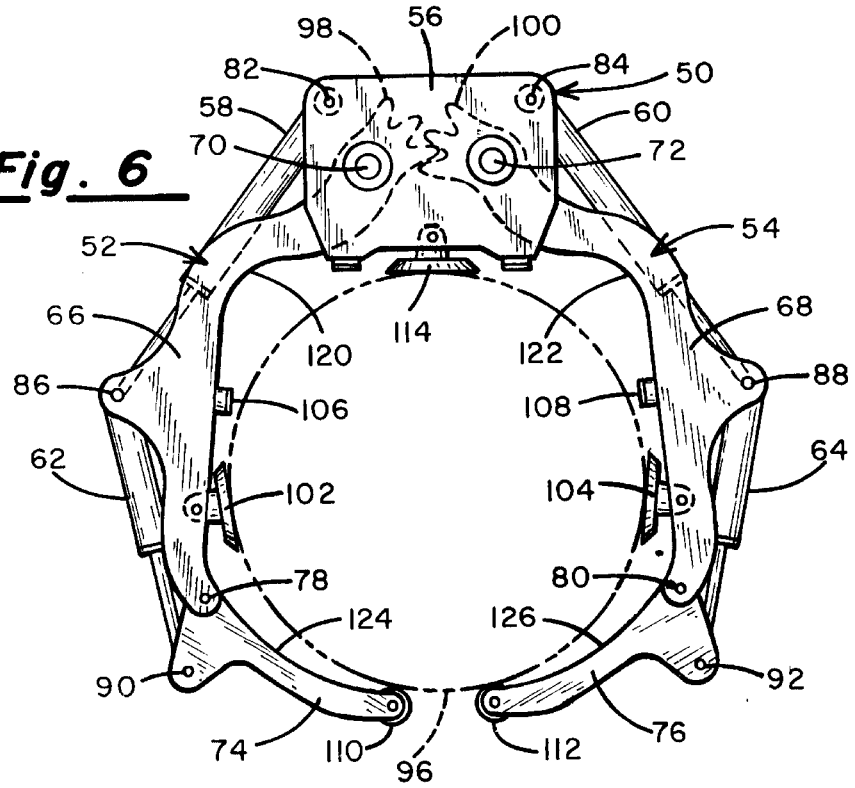
FIG. 6 is a view of the embodiment of FIG. 4 in the grasping position with reference to a circular object.

The second articulated arm embodiment of the grasping device of the present invention, shown in FIGS. 4–7, is indicated generally by 50. Two compound arms 52 and 54 are pivotally connected at one end to a support member 56 and are moved by inner arm actuators 58 and 60 and outer arm actuators 62 and 64. The actuators may be hydraulic cylinders or other such devices. As described below, expanding and retracting actuators 58, 60, 62 and 64 moves arms 52 and 54 between an open or retracted position as shown in FIG. 4 and a grasping position as shown in FIGS. 5 and 6.

Arms 52 and 54 have respective inner members 66 and 68 pivotally connected to support member 56 at first support pivot points 70 and 72 and to outer members 74 and 76 at arm member pivot points 78 and 80. Inner actuators 58 and 60 are pivotally connected to support member 56 at second support pivot points 82 and 84 and to inner members 66 and 68 at actuator pivot points 86 and 88. Outer actuators 62 and 64 are pivotally connected to inner members 66 and 68 at actuator pivot points 86 and 88 and to the outer members 74 and 76 at offset pivot points 90 and 92, respectively.

As shown best in FIGS. 5 and 6, expanding inner actuators 58 and 60 closes the inner members 66 and 68 around the container of interest. Likewise, expanding the outer actuators 62 and 64 causes the members 74 and 76 to pivot about pivot points 78 and 80 to contact and grasp the container of interest 94 and 96. Coordinating gears 98 and 100 which mesh between the first support pivot points 70 and 72 coordinate the movement of arms 52 and 54 in grasping the container.

Members 66 and 68 carry attached suction cups 102 and 104 and finger bumpers 106 and 108, respectively. As shown in FIGS. 5 and 6, suction cups 102 and 104 are mounted on swivels to address the container of interest and the finger bumpers 106 and 108 also may contact the container of interest.

Rollers 110 and 112 rotatably attached to the outer end of members 74 and 76 operate to converge on containers of a variety of shapes including curved, rectangular, hexagonal and others to urge them toward the support member suction cup 114 mounted on a swivel to support member 56. The support member 56 includes attached bumper pads 116 and 118 to receive containers of various shapes as seen in FIG. 4, suction cup 114, together with bumper pads 116 and 118 attached to the outer surface of support member 56 that provide the container receiving surface protrude beyond the members 74, 76 with corresponding rollers 110, 112 which rest behind the outer surface of the support member 56 when fully retracted.

In the example shown, inner members 66 and 68 have first corresponding and opposed shaped inner surfaces 120 and 122 to engage the corners of a rectangular container 94. The outer members 74 and 76 have an arcuate shape and inner grip padded surfaces 124 and 126 to enclose and capture containers of other shapes.

Figure 7:
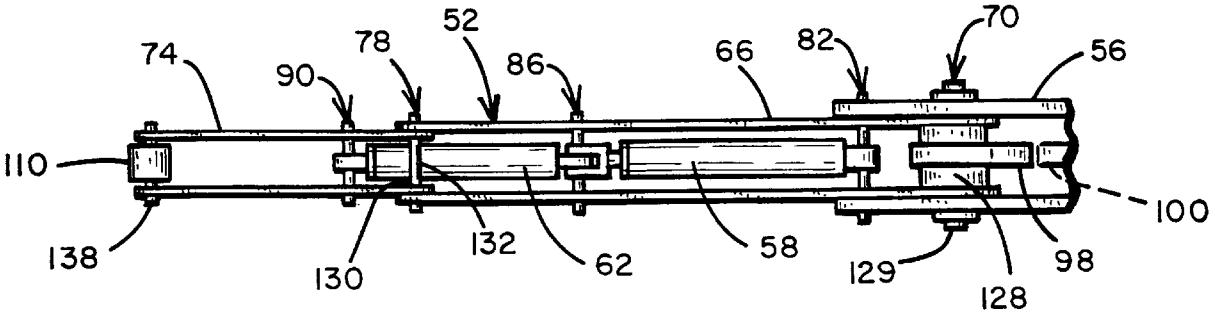
FIG. 7 is a side elevational view of one arm of the embodiment of FIG. 4 with the suction cup and finger bumper removed.

FIG. 7 is a side view of one of the articulated arms 52 and 54 of the grasping device 50, not showing the attached suction cup or finger bumper. Both arms 52 and 54 include identical opposed components and arm 52 includes inner member 66 having coordinating gear 98 next to first pivot point support 128. Inner member 66 is pivotally attached to support member 56 by pivot pin 129, or similar means. Outer member 74 is attached to inner member 66 in a similar joint arrangement as shown by outer arm member pivot point 130 adapted to be aligned with arm member pivot point 78 and pivot pin 132. Actuators 58 and 62 are pivotally attached to the support member 56 and inner and outer arm members 66 and 74 with similar wrist pin arrangements. Roller 110 rotates about retaining pin 138.

Figure 8:
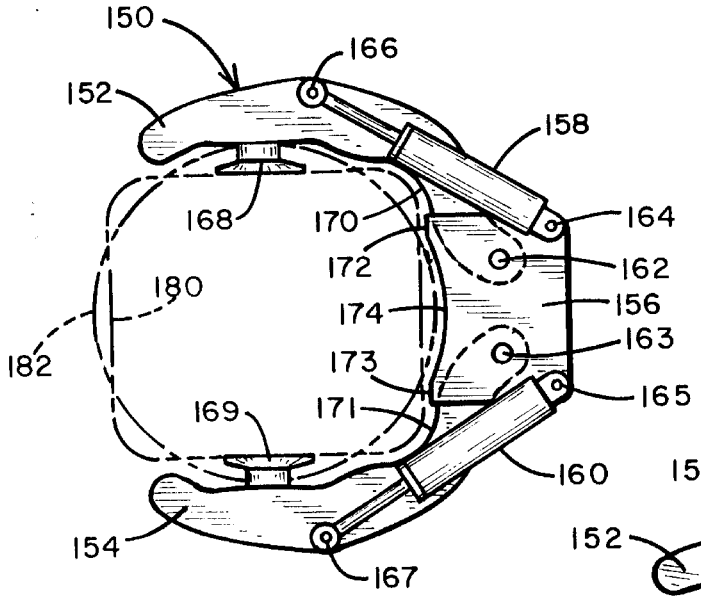
FIG. 8 is a top view depicting a single member arm embodiment grasping a rectangular object.
Figure 9:
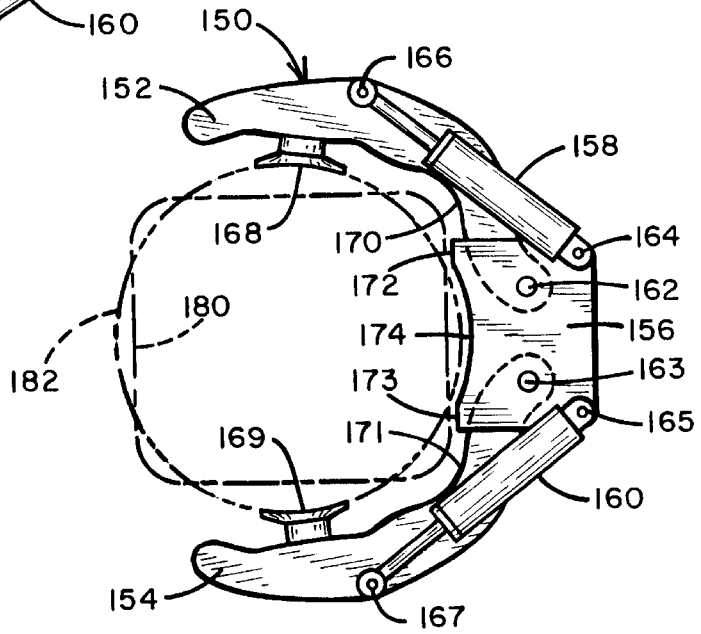
FIG. 9 is a view of the embodiment of FIG. 8 grasping a circular object.

A third embodiment of the grasping device of the invention is shown in FIGS. 8 and 9 and indicated generally by the numeral 150. The grasping device 150 has two arms 152 and 154 pivotally connected at first proximal pivot points 162 and 163 to a support member 156. Hydraulic cylinder actuators 158 and 160 are pivotally connected at pivot points 164 and 165 to the support member 156 and at member pivot points 166 and 167 to the arms 152 and 154.

Pivot points 162 and 163 are situated relatively close together inside the pivot points 164 and 165 in the support member 156. Thus, hydraulic cylinder actuators 158 and 160 operate the arms 152 and 154 about pivot points 162 and 163 to open or close around and grip the container of interest.

Arms 152 and 154 may carry suction cups as at 168 and 169, respectively, which help to accommodate containers having a plurality of different shapes, including circular, curved, rectangular, elliptical or hexagonal shapes. Broken lines in FIGS. 8 and 9 depict the grasping device 150 holding a rectangular container 180 and a rounded or circular container 182.

Arms 152 and 154 of the device 150 have corresponding opposed shaped inner surfaces 170 and 171 that fit around the corners of a geometrically shaped container, such as rectangular container 180. Support member 156 includes flat portions 172 and 173 to receive the container 180 and rounded portions or elements 174 to accept a circular container 182.

Advantages, including the relatively few required parts and greater versatility of the present invention compared to other devices are apparent from the above description. Any embodiment of this invention may be connected to any compatible lifting device, such as a forklift vehicle or a compound arm attached to a refuse truck. The fluid cylinder actuators may be driven by any suitable fluid system, including chassis mounted hydraulic systems.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A fully retractable material handling apparatus for grasping and releasing a container comprising:

(a) a support member for carrying a pair of opposed arms and having an outer edge defining a corresponding container-receiving surface;

(b) a pair of opposed arms aligned in spaced relation for grasping and releasing a container of interest wherein each arm of said pair of opposed arms comprises a plurality of sequentially segmented members including an inner member and an outer member, each of said inner members having a first end pivotally connected to said support member at a first point and a second end pivotally connected to a first end of a corresponding outer member at a second point, each of said outer members having a free end, and wherein said sequentially segmented members are capable of conforming to various shapes;

(c) a mechanized actuating means for operating said pair of opposed arms between a retracted position and a grasping position;

(d) wherein in said grasping position, said sequentially segmented members extend outward beyond said container receiving surface to grasp a container and hold a grasped container against said container-receiving surface of said support member and wherein in said retracted position said sequentially segmented members are opened to a position such that said free ends of said outer members retract behind and do not protrude outward beyond said corresponding container-receiving surface of said support member;

(e) wherein said mechanized actuating means for operating said pair of opposed arms comprises a first actuating means including a pair of inner linear actuators each connected between said support member and a corresponding inner member of one arm of said pair of opposed arms and further comprising a second actuating means including a pair of outer linear actuators each connected between said inner member and a corresponding outer member of one arm of said pair of opposed arms, each arm thereby having an inner and an outer linear actuator, said first and second actuating means cooperating to operate said inner and outer members of said pair of opposed arms between a retracted position and a grasping position; and wherein said inner and outer linear actuators of each said arms are connected at a common pivot point between said actuators; and (f) wherein said container-receiving surface includes both contoured and planet elements to receive containers having a plurality of geometries.

2. The apparatus as in claim 1 wherein each arm of said pair of opposed arms further comprises a suction cup attached to the inner member.

3. The apparatus as in claim 1 further comprising suction cup means attached to each of said pair of opposed arms for holding a plurality of geometrically shaped objects.

4. The apparatus as in claim 1 wherein said inner member of each arm of said pair of opposed arms has a gear means for meshing with the gear means of the other to coordinate movement of said pair of opposed arms.

5. The apparatus as in claim 1 wherein said free end of each of said outer member comprises a follower means to assist in guiding said segmented members about said container of interest.

6. The apparatus as in claim 1 wherein said inner member of each arm of said pair of opposed arms has a gear means wherein said gear means mesh together to coordinate movement of said pair of opposed arms.

7. The apparatus of claim 1 wherein said container-receiving surface includes a suction cup.

* * * * *